US007927124B1

(12) United States Patent
Dong et al.

(10) Patent No.: US 7,927,124 B1
(45) Date of Patent: Apr. 19, 2011

(54) CONNECTOR

(75) Inventors: Ting Dong, Shenzhen (CN); Fu-Bo Gong, Shenzhen (CN); Wen-Hsiang Lu, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/752,144

(22) Filed: Apr. 1, 2010

(30) Foreign Application Priority Data

Dec. 8, 2009 (CN) ..... 2009 1 0311080

(51) Int. Cl.
*H01R 13/627* (2006.01)

(52) U.S. Cl. ..... 439/353

(58) Field of Classification Search ..... 439/350–358
See application file for complete search history.

(56) References Cited

U.S. PATENT DOCUMENTS 4,089,579 A * 5/1978 Steinbach ..... 439/353
* cited by examiner

*Primary Examiner* — Javaid Nasri
(74) *Attorney, Agent, or Firm* — Zhigang Ma

(57) ABSTRACT

A connector comprises a first connection portion and a second connection portion. The first connection portion comprises a first receiving hole, a first set of conductive terminals received in the first receiving hole and a first hook portion protruded from an outer surface of the first connection portion. The second connection portion comprises a second receiving hole, a second set of conductive terminals and a second hook portion. Wherein the second receiving hole is formed in the inside of the second connection portion. The second hook portion is protruded from a side plate of the second receiving hole. Wherein, at least one of the first hook portion and the second hook portion is elastic.

7 Claims, 4 Drawing Sheets

CONNECTOR

BACKGROUND

1. Technical Field

The present disclosure relates to connectors, more particularly, to a connector that can be quickly installed and removed.

2. Description of Related Art

Many lighting devices use light-emitting diodes. However, a light emitting diode is generally fixed together with a light body of the lighting device, and is thus difficult to be installed or removed.

Therefore, it is desirable for a new connector to be used to address the above-described shortcoming.

BRIEF DESCRIPTION OF THE DRAWINGS

The components in the drawings are not necessarily drawn to scale, the emphasis instead being placed upon clearly illustrating the principles of the connector. Moreover, in the drawings, like reference numerals designate corresponding parts throughout the several views.

DETAILED DESCRIPTION

Figure 1:
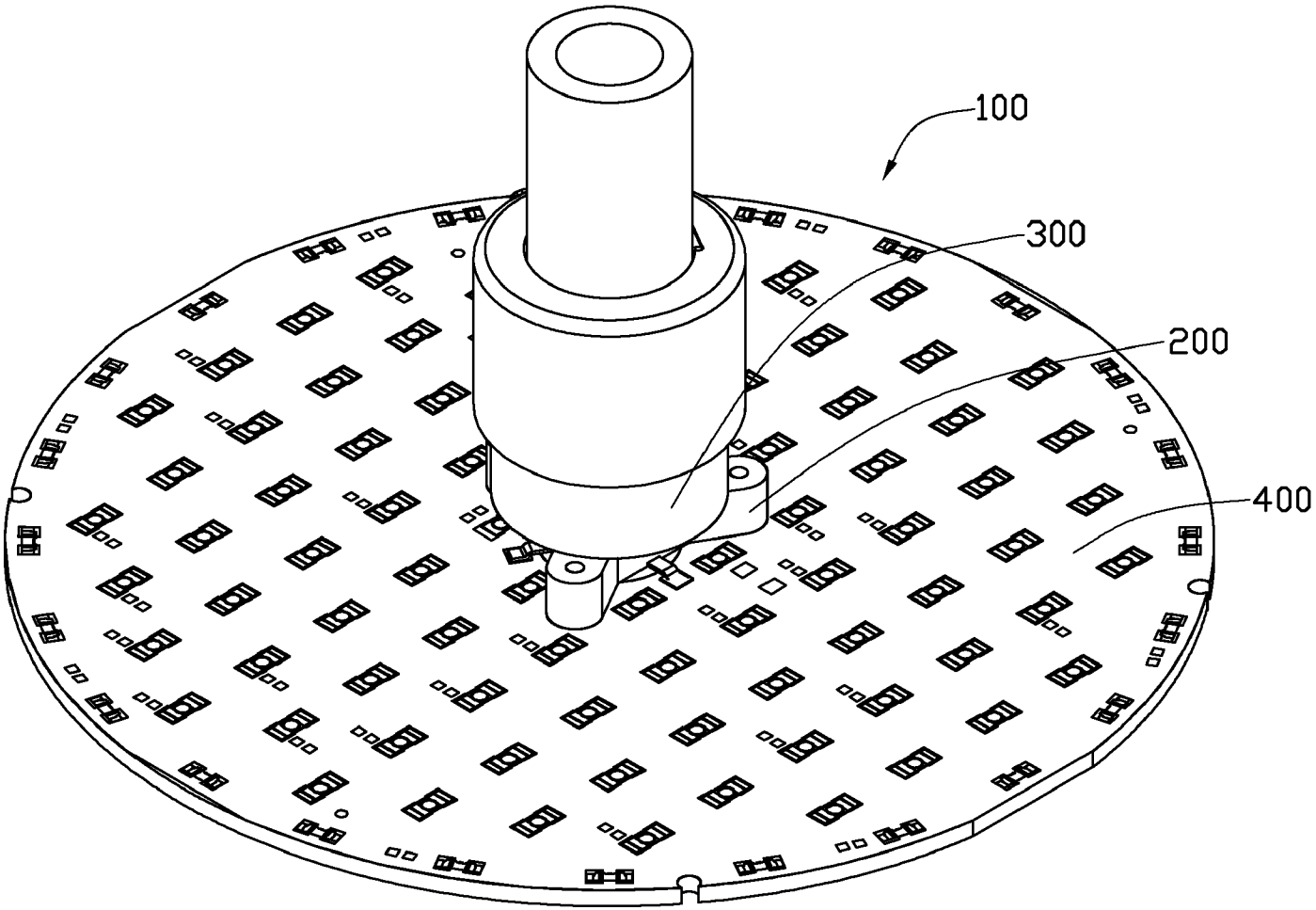
FIG. 1 is an isometric view of a connector connected to a light emitting diode, in accordance with an exemplary embodiment.
Figure 2:
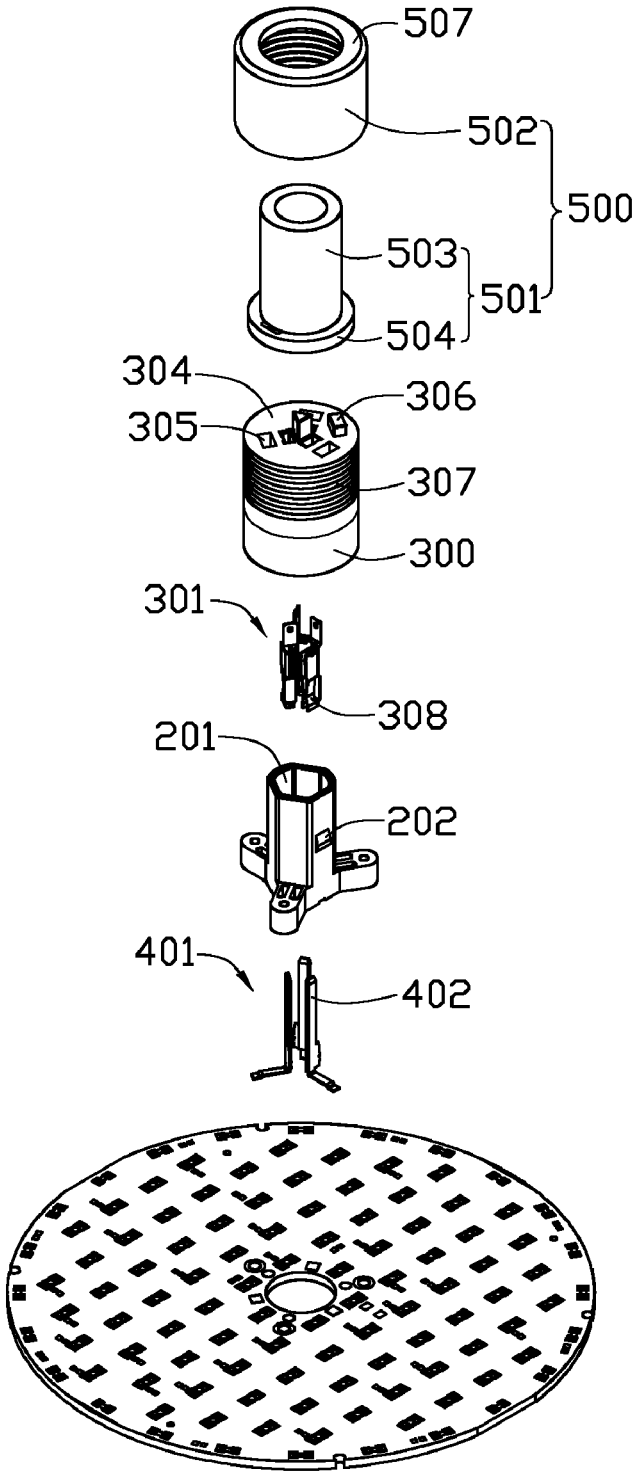
FIG. 2 is an exploded view of the connector in FIG. 1.

Referring to FIGS. 1-2, a connector 100 includes a first connection portion 200 and a second connection portion 300. The first connection portion 200 is fixedly connected to a light emitting diode (LED) 400. The light emitting diode (LED) 400 includes a first set of conductive terminals 401.

Figure 3:
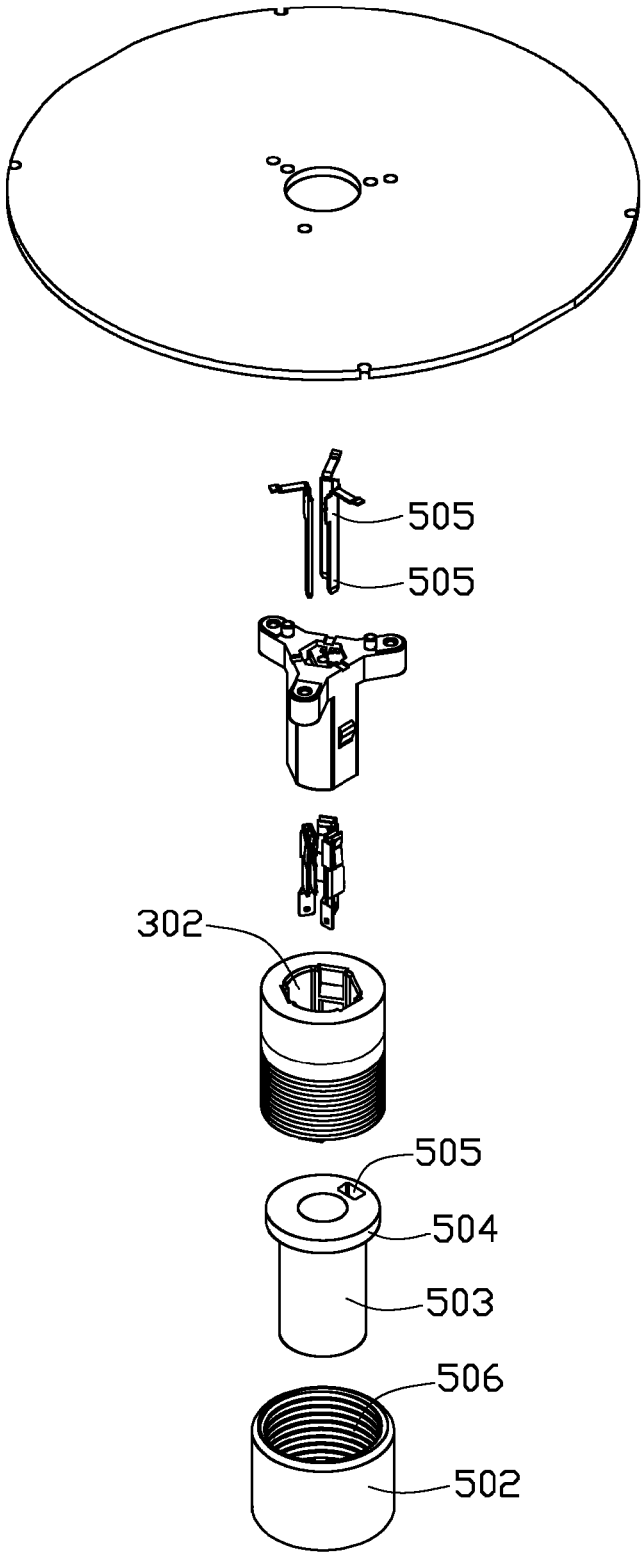
FIG. 3 is an inverted view of the connector of FIG. 2.
Figure 4:
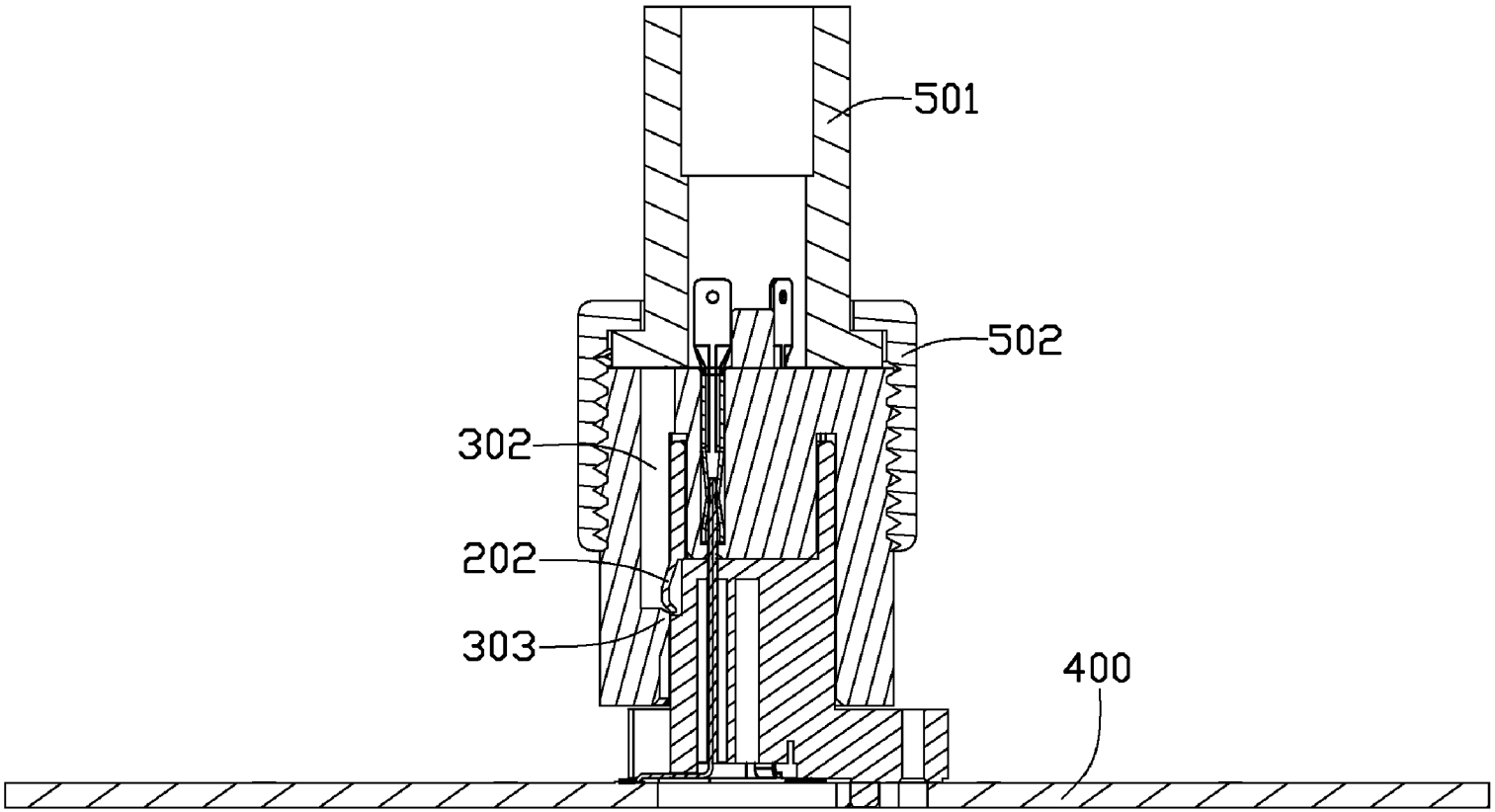
FIG. 4 is a cross sectional view of the connector of FIG. 1.

Referring to FIGS. 3-4, the first connection portion 200 includes a first receiving hole 201. The first set of conductive terminals 401 are received in the first receiving hole 201. The first set of conductive terminals 401 includes three terminals 402. A first hook portion 202 is protruded from an outer surface of the first connection portion 200.

The second connection portion 300 includes a second set of conductive terminals 301 and a second receiving hole 302. The second set of conductive terminals 301 includes three terminals 308. The second receiving hole 302 is formed in the inside of the second connection portion 300. The second receiving hole 302 is used for receiving the first connection portion 200 and the second set of conductive terminals 301. A second hook portion 303 protrudes from a side plate of the second receiving hole 302. One end of the second connection portion 300 is a blind end, which includes three through holes 305 and a protruding portion 306. The terminals of the second set of conductive terminals 301 pass through the three through holes 305. A thread 307 is formed in the outer surface of the second connection portion 300.

At least one of the first hook portion 202 and the second hook portion 303 is elastic. In the exemplary embodiment, the first hook portion 202 is a protruding elastic tab. The first hook portion 202 can be elastically deformed under an external force. The first hook portion 202 and the second hook portion 303 cooperate to connect the first connection portion 200 to the second connection portion 300.

During insertion of the first connection portion 200 into the second connection portion 300, the first hook portion 202 is pressed inward by the portion 303 until passing the end of the second hook portion 303 and rebounding and is thus hooked by the portion 303. After the first connection portion 200 hooks the second connection portion 300, the first set of conductive terminals 401 contacts the second set of conductive terminals 301. In the exemplary embodiment, the terminals 308 of the second set of conductive terminals 301 contact with the terminals 402 of the first set of conductive terminals 401.

In the exemplary embodiment, the connector 100 further includes a protection sleeve 500. The protection sleeve 500 includes a connection pipe 501 and a connection sleeve 502. The connection sleeve 502 is connected to the second connection portion 300. The connection sleeve 502 is used for fixing the connection pipe 501 on the second connection portion 300. The connection pipe 501 includes a pipe body 503 and a circular flange 504. The flange 504 is formed on an end of the pipe body 503 and extends outwards along a periphery of the pipe body 503. A engaging portion 505 is formed in the upper surface of the flange 504. The engaging portion 505 is formed on a surface of the flange 504 to engage with the second connection portion 300. The protruding portion 306 is engaged with the engaging portion 505 of the flange 504 to stop the second connection portion 300 and the protection sleeve 502 from moving relative to each other. A thread 506 is formed in the inner surface of the connecting sleeve 502 and engages the thread 307. A circular stopper 507 is formed at one end of the connecting sleeve 502. The connection pipe 501 passes through the connection sleeve 502. The connecting sleeve 502 is used for connecting the second connecting portion 300 to flange 504.

Finally, while the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure as defined by the appended claims.

What is claimed is:

1. A connector comprising:

a first connection portion fixedly connected a light emitting diode (LED), comprising a first receiving hole, a first set of conductive terminals received in the first receiving hole, and a first hook portion protruded from an outer surface of the first connection portion; and a second connection portion comprising a second receiving hole, a second set of conductive terminals, and a second hook portion protruding from an inner surface of the second receiving hole;

wherein, at least one of the first hook portion and the second hook portion is elastic, when the first hook portion is connected with the second hook portion, the first connection portion connection is connected to the second connection portion, and the first set of conductive terminals contact the second set of conductive terminals.

2. The connector according to claim 1, further comprising a protection sleeve, wherein the protection sleeve is connected to the second connection portion, the protection sleeve comprises a connection pipe and a connection sleeve, the connection pipe is mounted to the second connection portion via the connection sleeve.

3. The connector as described in claim 2, wherein the connection pipe comprises a pipe body and a flange formed on an end of the pipe body and extending outwards along a periphery of the pipe body, a engaging portion is formed on a surface of the flange to engage with the second connection portion.

4. The connector as described in claim 3, wherein the connection sleeve is a hollow cylinder having an internal surface, an inner screw thread is formed in the internal surface of the connection sleeve, the inner screw thread cooperates with the second connection portion, a circular stopper is formed on one end of the connection sleeve to abut against the second connection portion.

5. The connector as described in claim 3, wherein the second receiving hole is used for receiving the first connection portion, one end of the second connection portion is a blind end, the blind end defines three through holes and a protruding portion, the terminals of the second set of conductive terminals protrude from the three through holes, the protruding portion is engaged with the engaging portion of the flange to stop the second connection portion and the protection sleeve from moving relative to each other.

6. The connector as described in claim 4, wherein an outer screw thread is formed on an outer surface of the second connection portion, the outer screw thread cooperates with the inner screw thread of the connection sleeve.

7. The connector as described in claim 1, wherein one end of each terminal of the second set of the conductive terminals comprises two elastic arms, the two elastic arms are used for holding one terminal of the first set of the conductive terminals.

* * * * *